US008368376B2

(12) United States Patent
Cheng et al.

(10) Patent No.: US 8,368,376 B2
(45) Date of Patent: Feb. 5, 2013

(54) ELECTRONIC DEVICE WITH POWER SWITCH CAPABLE OF REGULATING POWER DISSIPATION

(75) Inventors: Chieh-Wen Cheng, Hsinchu (TW); San-Yi Li, Tainan County (TW)

(73) Assignee: Anpec Electronics Corporation, Hsinchu Science Park, Hsin-Chu (TW)

( * ) Notice: Subject to any disclaimer, the term of this patent is extended or adjusted under 35 U.S.C. 154(b) by 400 days.

(21) Appl. No.: 12/714,557

(22) Filed: Mar. 1, 2010

(65) Prior Publication Data

US 2011/0043178 A1 Feb. 24, 2011

Related U.S. Application Data

(60) Provisional application No. 61/236,122, filed on Aug. 23, 2009.

(30) Foreign Application Priority Data

Dec. 16, 2009 (TW) ..... 098143118

(51) Int. Cl.
*G05F 1/40* (2006.01)

(52) U.S. Cl. ..... 323/285; 323/280

(58) Field of Classification Search ..... 323/222, 323/266, 271, 275, 282–288; 363/17, 20, 363/21.12, 21.08, 45, 46, 78, 79, 81, 89, 363/127

See application file for complete search history.

(56) References Cited

U.S. PATENT DOCUMENTS

| | | | | |
|---|---|---|---|---|
| 4,064,448 | A * | 12/1977 | Eatock | 323/281 |
| 4,095,165 | A * | 6/1978 | Boros | 323/283 |
| 5,717,319 | A * | 2/1998 | Jokinen | 323/280 |
| 5,969,962 | A * | 10/1999 | Gabor | 363/89 |
| 6,400,203 | B1 * | 6/2002 | Bezzi et al. | 327/309 |
| 6,819,165 | B2 * | 11/2004 | Ho et al. | 327/541 |
| 7,007,176 | B2 * | 2/2006 | Goodfellow et al. | 713/300 |
| 7,176,668 | B2 * | 2/2007 | Oswald et al. | 323/285 |
| 8,067,925 | B2 * | 11/2011 | Grimm | 323/274 |

FOREIGN PATENT DOCUMENTS

JP 2005323413 11/2005

* cited by examiner

*Primary Examiner* — Rajnikant Patel
(74) *Attorney, Agent, or Firm* — Winston Hsu; Scott Margo

(57) ABSTRACT

An electronic device with a power switch capable of regulating power dissipation includes a power supply device; a power switch, for providing an output voltage; and a current regulating circuit, which includes an adaptive control unit, for outputting a regulating signal, according to the voltage difference between the power supply device and the output voltage; and a switch control unit, for outputting a switch control signal to control the magnitude of the current through the power switch, according to the regulating signal.

11 Claims, 9 Drawing Sheets

ELECTRONIC DEVICE WITH POWER SWITCH CAPABLE OF REGULATING POWER DISSIPATION

CROSS REFERENCE TO RELATED APPLICATIONS

This application claims the benefit of U.S. Provisional Application No. 61/236,122, filed on Aug. 23, 2009 and entitled "Adaptive current limiting controller", the contents of which are incorporated herein by reference.

BACKGROUND OF THE INVENTION

1. Field of the Invention

The present invention relates to an electronic device capable of regulating a power switch to dissipate power, and more particularly, to an electronic device capable of avoiding abnormal operation due to overheating of a power switch.

2. Description of the Prior Art

Nowadays, there are a variety of electronic devices. For normal activation and operation, an electronic device needs to undergo a turn-on process. After power-on, power switches of a power supply device in the electronic device are first turned on, to transfer power of a primary power source to each circuit element in the electronic device. The power switches utilized for controlling power transferring are often realized by field-effect transistors (FETs) or bipolar junction transistors (BJTs). According to operation principle of an FET, current conduction between a drain and a source is controlled by a gate voltage of the FET. In a normal situation, after the power switches are turned on, each circuit element can start to operate. However, there is an overheating issue if FETs are applied as power switches.

Please refer to FIG. 1A, which is a schematic diagram of a conventional electronic device 10. The electronic device 10 includes a power supply device 100, a transistor M1, a capacitor C1 and a load LOAD1. The transistor M1 is an N-TYPE FET and acts as a power switch. When a gate voltage of the transistor M1 shifts from a low-level voltage to a high-level voltage, the current provided by the power supply device 100 can flow from a drain to a source, to charge the capacitor C1. Noticeably, at the moment that the drain and the source of the transistor M1 are conducted, a voltage across the capacitor C1 is around 0 volt, such that the source voltage of the transistor M1 is around 0 volt as well. Since the drain voltage of the transistor M1 substantially equals an output voltage of the power supply device 100, voltage difference between the drain and the source reaches maximum at the moment that the transistor M1 is turned on. Meanwhile, since the conduction current of the transistor M1 increases significantly, the transistor M1 has a great voltage difference and a great conduction current at the same time. According to operate principles of semiconductors, thermal power released by the transistor M1 substantially equals a product of the voltage difference between the drain and the source and the conduction current. Therefore, when a great voltage difference and a great conduction current exist at the same time, the transistor M1 instantly releases a great amount of thermal energy, causing the transistor M1 to activate overheating protection mechanism due to overheating, which protects the transistor M1 by automatic shut down, but the transistor M1 may have been burnt out by overheating.

Please refer to FIG. 1B, which is a time distribution diagram of the voltage drop, the conduction current and the thermal energy of the transistor M1 shown in FIG. 1A at power-on. After the electronic device 10 is turned on, the source voltage of the transistor M1 increases from 0 volt to the voltage provided by the power supply device 100 gradually. On the other hand, the drain voltage of the transistor M1 substantially equals to the output voltage of the power supply device 100 before the electronic device 10 is turned on, and the voltage difference between the drain and the source of the transistor M1 decreases gradually after the electronic device 10 is turned on. In addition, the current flowing through the transistor M1 increases rapidly from 0 A to a maximum value IMAX at a time TA. As mentioned before, after the transistor M1 is conducted, the transistor M1 includes a great voltage difference between the drain and the source and a great conduction current at the same time. In other words, the transistor M1 instantly releases a great amount of thermal energy around the time TA, causing the transistor M1 automatic shut down due to overheating, or immediately burned out.

Therefore, at the moment that the electronic device is turned on, the voltage difference between the drain and the source of the FET acting as a power switch is great. If the current flowing through the FET increases to a high level at the same time, the FET would instantly release too much thermal energy, which overheats the FET, such that the thermal shutdown mechanism is activated, or power switch is immediately burned out, causing the electronic device incapable of working normally.

SUMMARY OF THE INVENTION

It is therefore an objective of the present invention to provide an electronic device capable of regulating a power switch to dissipate power.

The present invention discloses an electronic device capable of regulating a power switch to dissipate power. The electronic device includes a power supply device, for supplying a power voltage, a power switch, for providing an output voltage, and a current regulating circuit. The current regulating circuit includes an adaptive control unit, for outputting a regulating signal according to a voltage difference between the power voltage and the output voltage, and a switch control unit, for outputting a switch control signal according to the regulating signal, to control current flowing through the power switch.

The present invention further discloses a current regulating circuit for regulating power dissipation of a power switch. The power switch is utilized for regulating a power voltage outputted by a power supply device to provide an output voltage. The current regulating circuit includes an adaptive control unit, for outputting a regulating signal according to a voltage difference between the power voltage and the output voltage, and a switch control unit, for outputting a switch control signal according to the regulating signal, to control current flowing through the power switch.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 1B is a time distribution diagram showing the voltage drop, the conduction current and the thermal energy of the power switch shown in FIG. 1A when the electronic device is turned on.

FIG. 4 is time distribution diagram showing the voltage drop, the conduction current and the thermal energy of the power switch in FIG. 2A or FIG. 3A when the electronic device is turned on.

DETAILED DESCRIPTION

Figure 2A:
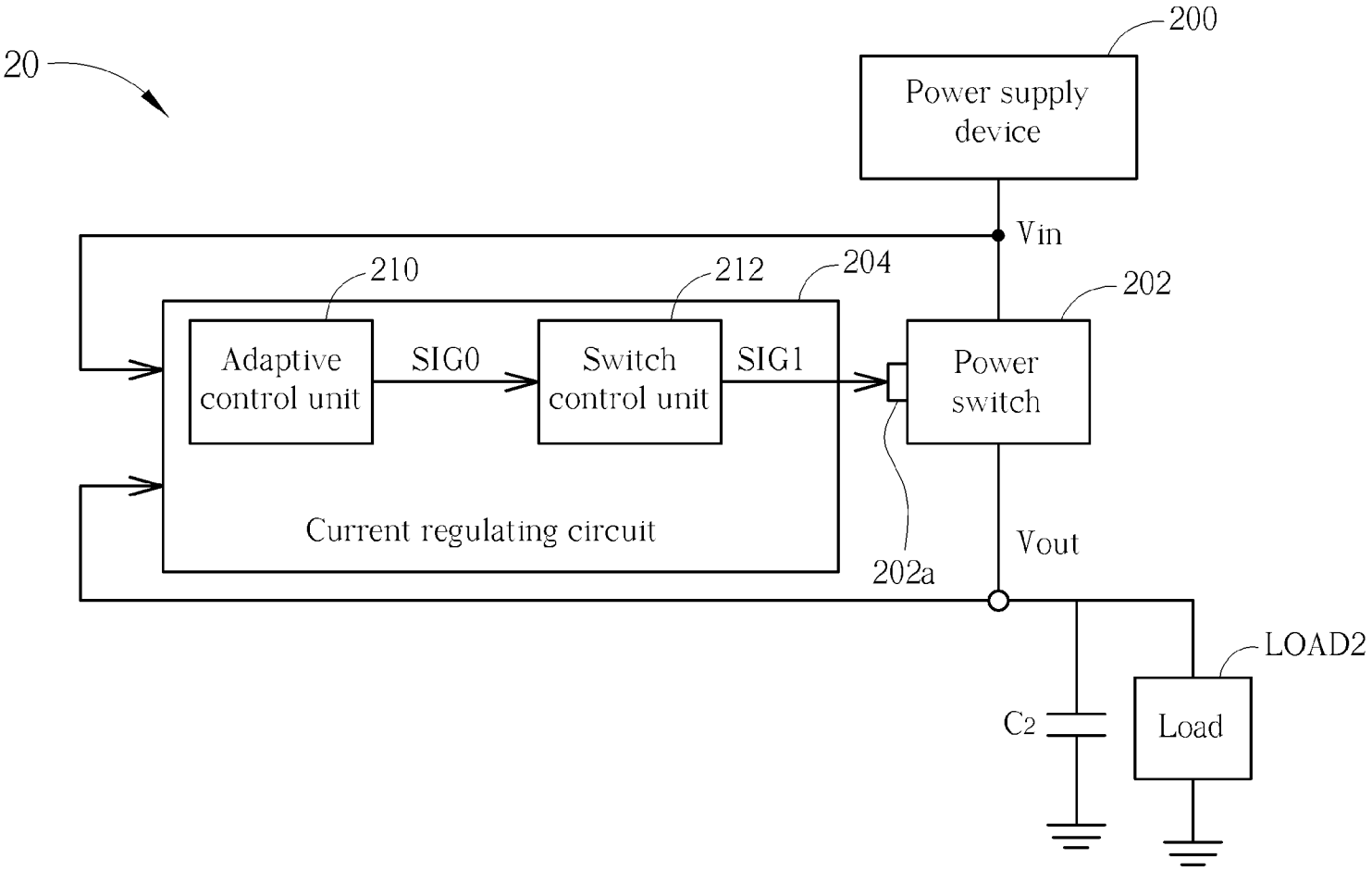
FIG. 2A is a schematic diagram of an electronic device according to an embodiment of the present invention.

Please refer to FIG. 2A, which is a schematic diagram of an electronic device 20 according to an embodiment of the present invention. The electronic device 20 can regulate power dissipation of a power switch, and includes a power supply device 200, a power switch 202, an output capacitor C2, a load LOAD2 and a current regulating circuit 204. The power supply device 200 is utilized for providing an input voltage Vin. The power switch 202 regulates current flowing through the power switch 202 according to voltage of a control terminal 202*a*. The output capacitor C2 is charged after the power switch 202 is conducted, and the load LOAD2 provides a specific power load. The current regulating circuit 204 includes an adaptive control unit 210 and a switch control unit 212, for providing a regulating signal to the control terminal 202*a* of the power switch 202 according to the input voltage Vin and an output voltage Vout of the power switch 202, to regulate the current flowing through the power switch 202. In detail, the adaptive control unit 210 is utilized for outputting a regulating signal SIG0 according to a voltage difference between the input voltage Vin and the output voltage Vout . The switch control unit 212 outputs a switch control signal SIG1 according to the regulating signal SIG0, to control the current flowing through the power switch 202.

In a word, the electronic device 20 regularly adjusts current flowing through the power switch 202, to avoid a great voltage difference and a great current (or current surge) across the power switch at the same time. Furthermore, please refer to FIG. 2B, which is a schematic diagram of the adaptive control unit 210. The adaptive control unit 210 includes a voltage divider 240, a multiplexer 242, a comparator 244, a counter 246, a logic controller 248 and a regulating current generator 250. The voltage divider 240 is utilized for providing standard voltages V_1~V_N. The multiplexer 242 is utilized for selecting a standard voltage V_x from the standard voltages V_1~V_N provided by the voltage divider 240 according to a selection signal SEL_1, to output a feedback reference voltage FBRV to the comparator 244. The comparator 244 compares magnitudes of the feedback reference voltage FBRV and the output voltage Vout, and outputs a trigger signal CRS to the counter 246 according to a comparison result. The counter 246 increases a count value according to a timing signal (not shown), and resets the count value according to the trigger signal CRS. The logic controller 248 outputs the selection signal SEL_1 according to the count value of the counter 246, to control selection of the multiplexer 242. Meanwhile, the logic controller 248 generates and outputs another selection signal SEL_2 to the regulating current generator 250. The regulating current generator 250 selects a reference current II_y from reference currents II_1~II_K according to the selection signal SEL_2 provided by the logic controller 248, to output the regulating signal SIG0 of the adaptive control unit 210. Besides, please refer to FIG. 2C, which is a schematic diagram of the switch control unit 212. The switch control unit 212 includes a current mirror CM1 and a resistor R1. The current mirror CM1 outputs a conversion current Itran according to the regulating signal SIG0 outputted by the adaptive control unit 210, and the resistor R1 converts the conversion current Itran into a voltage signal Vgate and outputs the voltage signal Vgate as the switch control signal SIG1 of the switch control unit 212 to the control terminal 202*a*, to control the conduction current of the power switch 202.

Therefore, when the power switch 202 starts conducting current, the current regulating circuit 204 suppresses the conduction current, and when the terminal voltage of the power switch 202 gradually decreases due to charging the output capacitor C2, the conduction current can correspondingly increase gradually. In order to realize this function, the selection signal SEL_2 outputted by the logic controller 248 is utilized for selecting a smaller reference current from the reference currents II_1~II_K, and the switch control unit 212 correspondingly outputs a switch control signal SIG1 for conducting small current to the control terminal 202*a*. Then, the current regulating circuit 204 utilizes the selection signal SEL_1 to select a smaller standard voltage FBRV from the standard voltages V_1~V_N provided by the voltage divider 240. The comparator 244 compares the output voltage Vout with this smaller standard voltage FBRV. Since when the power switch 202 starts conducting current, the output capacitor C2 is not charged yet, voltage difference of the output capacitor C2 is 0 V, and the output voltage Vout equals 0 V as well. As a result, if the output voltage Vout is compared with the small standard voltage FBRV, when the output voltage Vout gradually increases to exceed the voltage level of the standard voltage FBRV, the output signal CRS of the comparator 244 changes state, such that the counter 246 is reset. Then, the logic controller 248 alters values of the selection signal SEL_1 and the selection signal SEL_2 according to the count value of the counter 246, to increase the standard voltage FBRV and the reference current II_y, respectively. Then, the comparator 244 compares the output voltage Vout and the increased standard voltage FBRV, and the switch control unit 212 updates the output signal, for conducting greater current. By the method of gradually increasing the standard voltage FBRV and the reference current II_y, the output voltage Vout of the power switch 202 would substantially equal the input voltage Vin, and the occurrence of a great voltage difference and a great current at the same time can be avoided.

Noticeably, the electronic device 20 is only an embodiment of the present invention, and those skilled in the art can make modifications accordingly. For example, please refer to FIG. 3A, which is a schematic diagram of an electronic device 30 according to an embodiment of the present invention. The structure of the electronic device 30 is similar to that of the electronic device 20, such that the same elements are denoted by the same names and symbols, while elements with the same function and different structure are denoted by the same names but different symbols, such as a current regulating circuit 304 including an adaptive control unit 310 and a switch control unit 312. Differences between the electronic device 30 and the electronic device 20 are that the electronic device 30 is added with a sensing resistor Rsense, and a voltage signal Vsense of one terminal of the sensing resistor Rsense is connected to the switch control unit 312. In such a situation, as shown in FIG. 3B, a regulating voltage generator 350 of the adaptive control unit 310 is added with a resistor RR, for converting a selected reference current into a reference voltage signal VV_y as the regulating signal SIG0 outputted by the adaptive control unit 310, and output the regulating signal SIG0 to the switch control unit 312. In such a situation, as shown in FIG. 3C, the switch control unit 312 is realized by a comparator CMP1, for comparing the regulating signal SIG0 and the terminal voltage of the sensing resistor Rsense, and controlling current conduction of the power switch 202 accordingly. Therefore, the electronic device 30 can gradually regulate the current flowing through the power switch 202 as well.

Figure 2B:
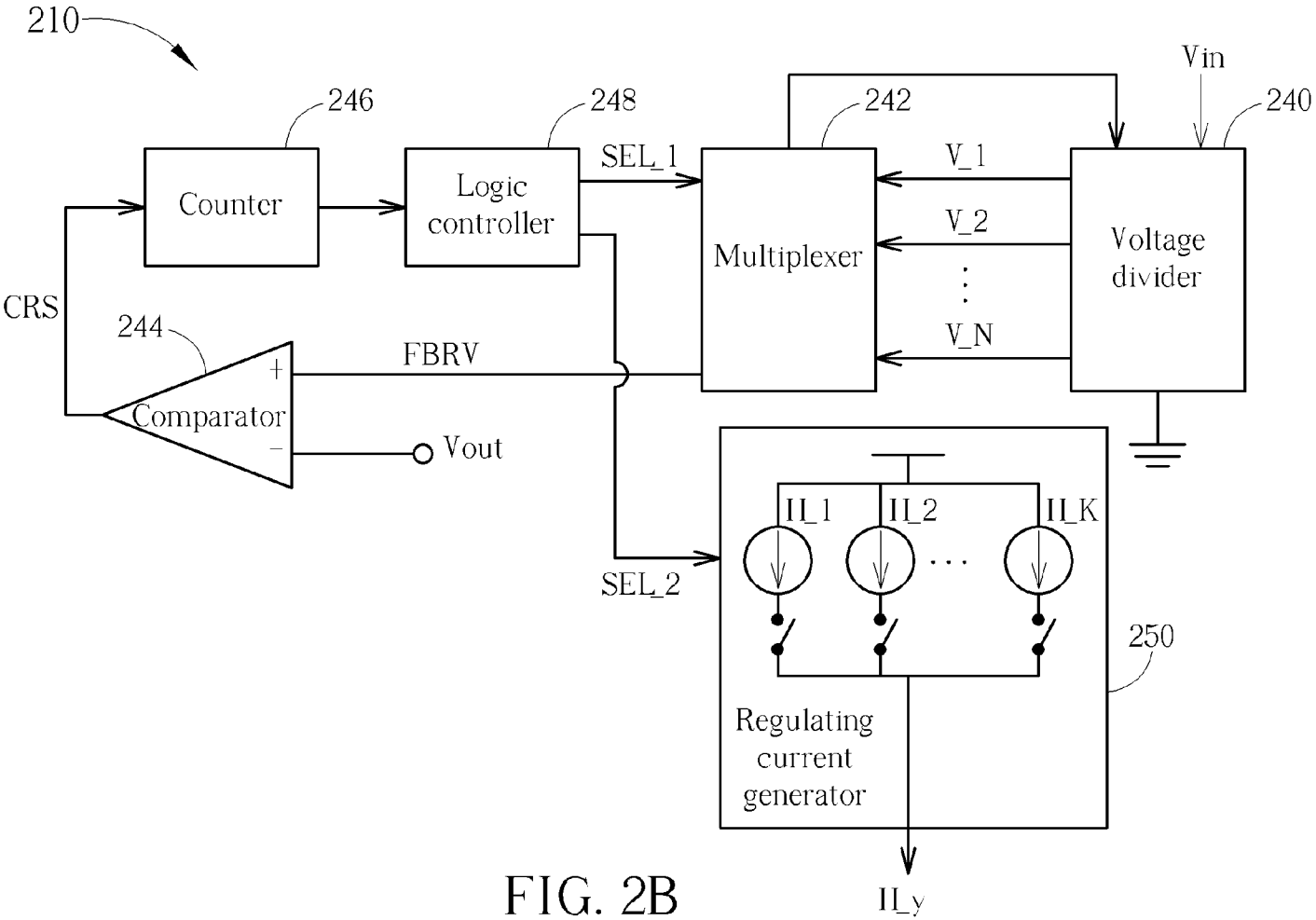
FIG. 2B is a schematic diagram of the adaptive control unit in FIG. 2A.
Figure 3A:
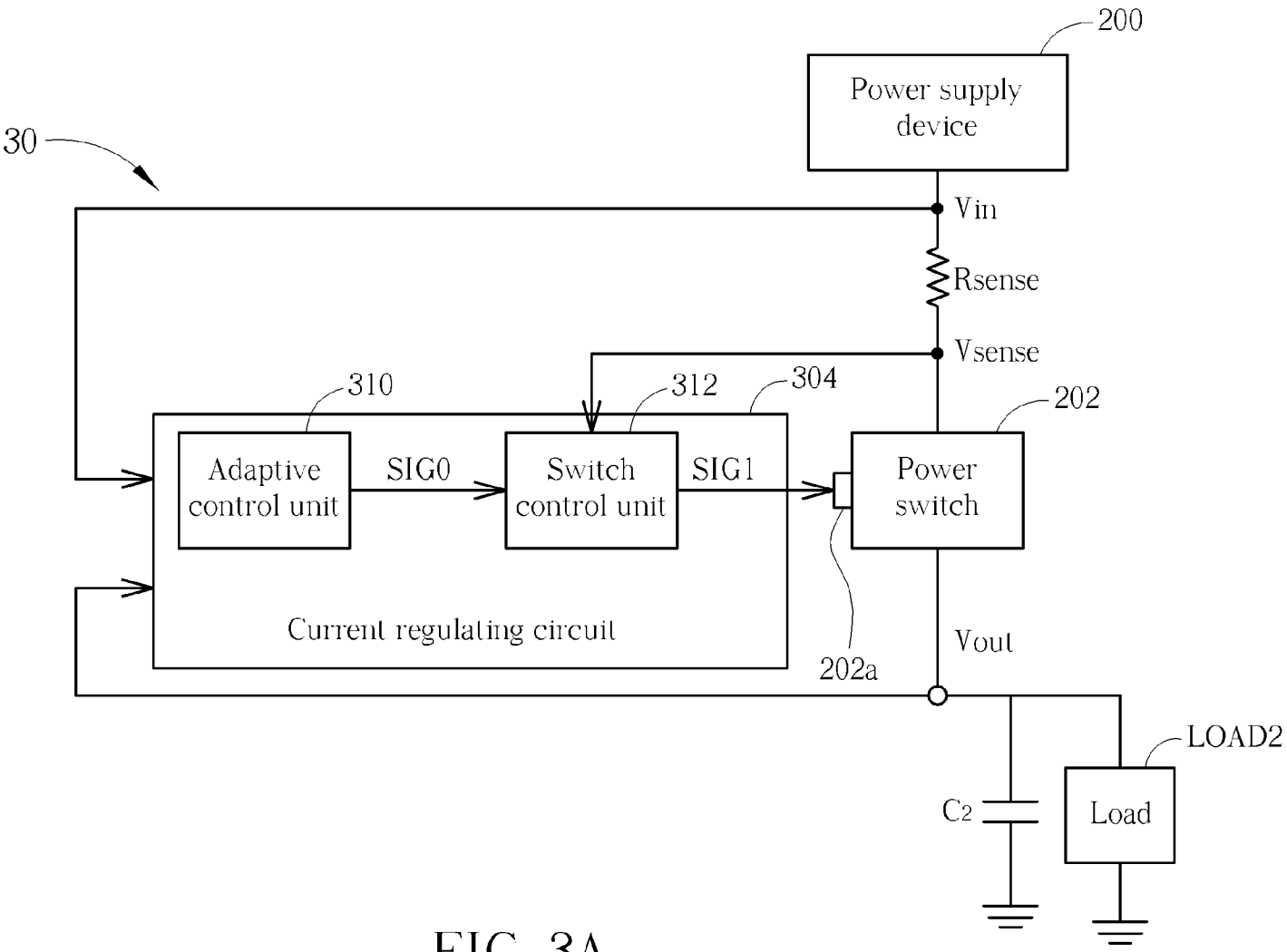
FIG. 3A is a schematic diagram of an electronic device according to an alteration of the present invention.
Figure 3B:
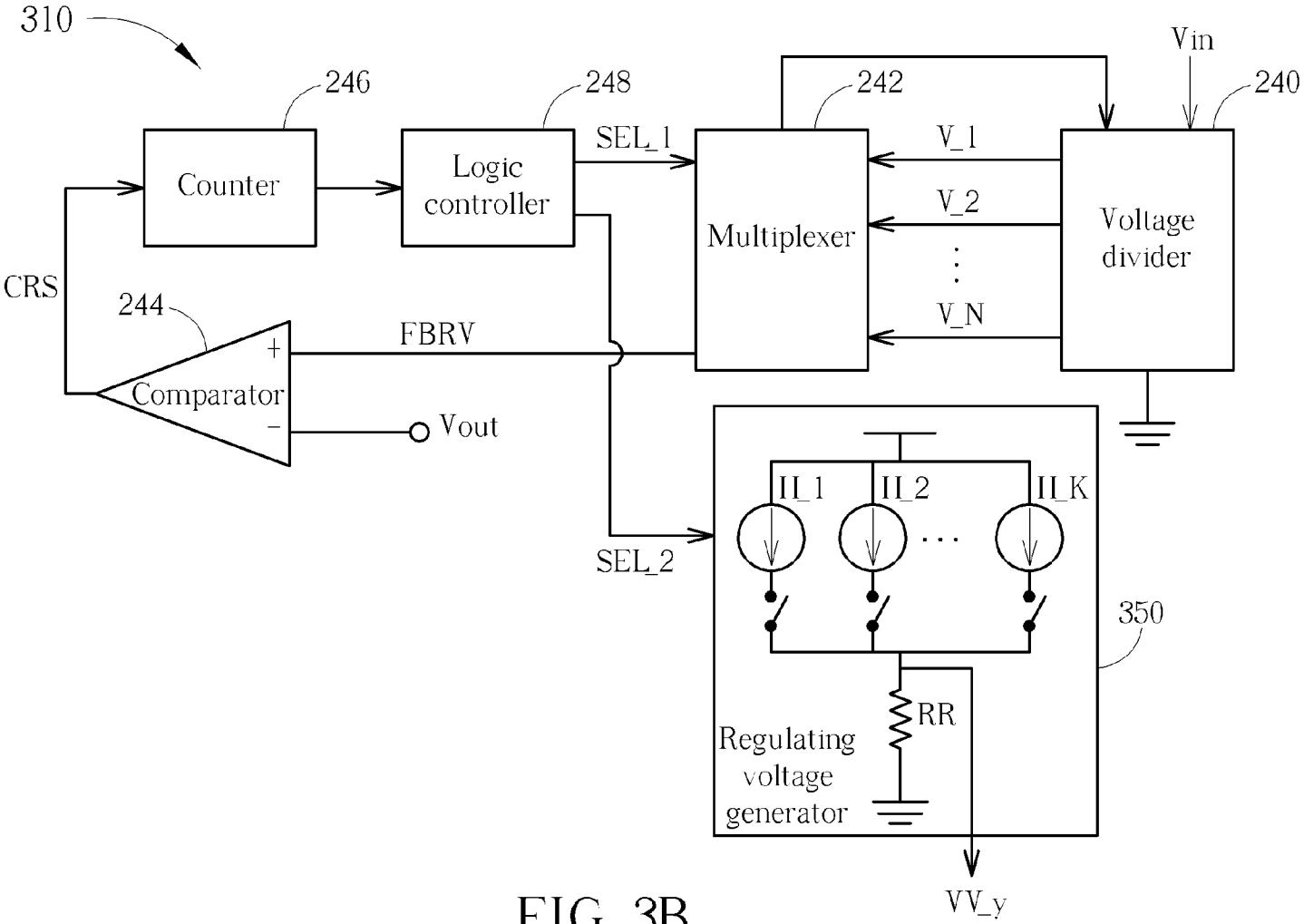
FIG. 3B is a schematic diagram of the adaptive control unit in FIG. 3A.
Figure 3C:
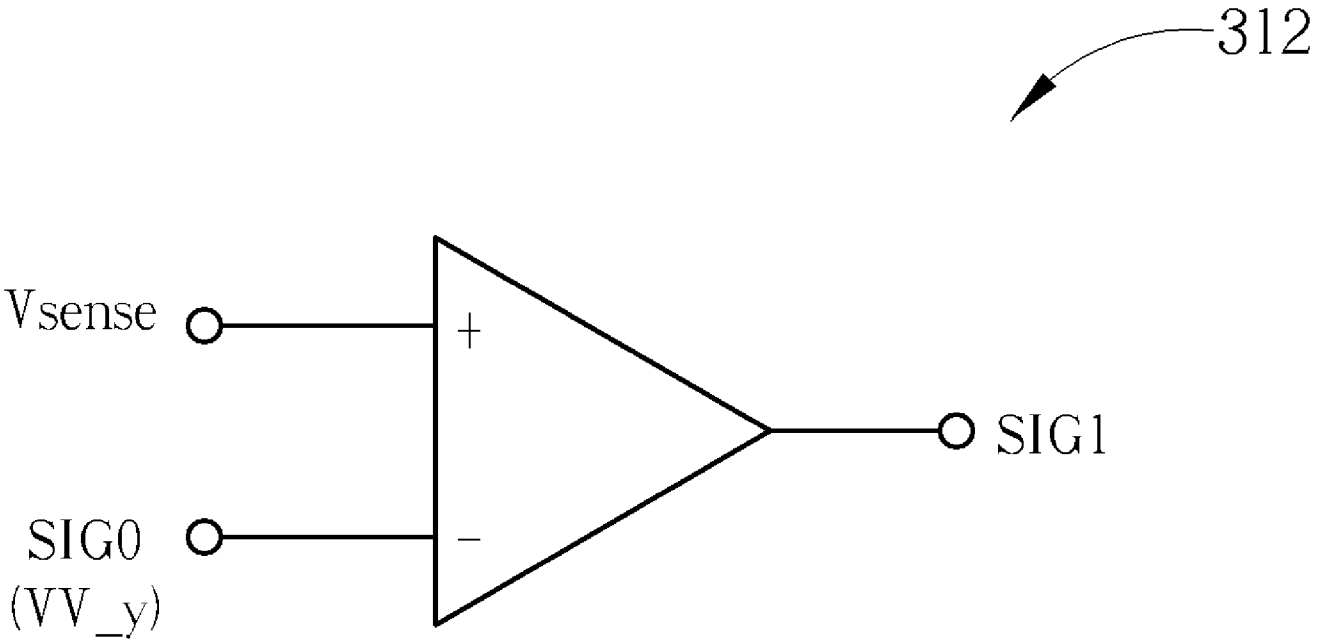
FIG. 3C is a schematic diagram of the switch control unit in FIG. 3A.

In FIG. 3A, the regulating signal SIG0 outputted by the adaptive control unit 310 is a reference voltage (in comparison, the regulating signal SIG0 in FIG. 2B is a reference current). In such a situation, the switch control unit 312 is correspondingly modified as the comparator CMP1, for comparing the regulating signal SIG0 and the terminal voltage of the sensing resistor Rsense, to detect the current flowing through the sensing resistor Rsense (i.e. the current flowing through the power switch 202) according to the voltage difference of the terminal voltage of the sensing resistor Rsense and the input voltage Vin. Then, the output of comparator CMP1 is taken as the switch control signal SIG1, to control current conduction of the power switch 202. As a result, the electronic device 30 can gradually regulate current flowing through the power switch 202 according to the current flowing through the power switch 202 and voltages of the input terminal and the output terminal of the power switch 202. Structures and operations of other elements of the electronic device 30 are the same as those of the electronic device 20, and are not narrated hereafter.

Figure 1A:
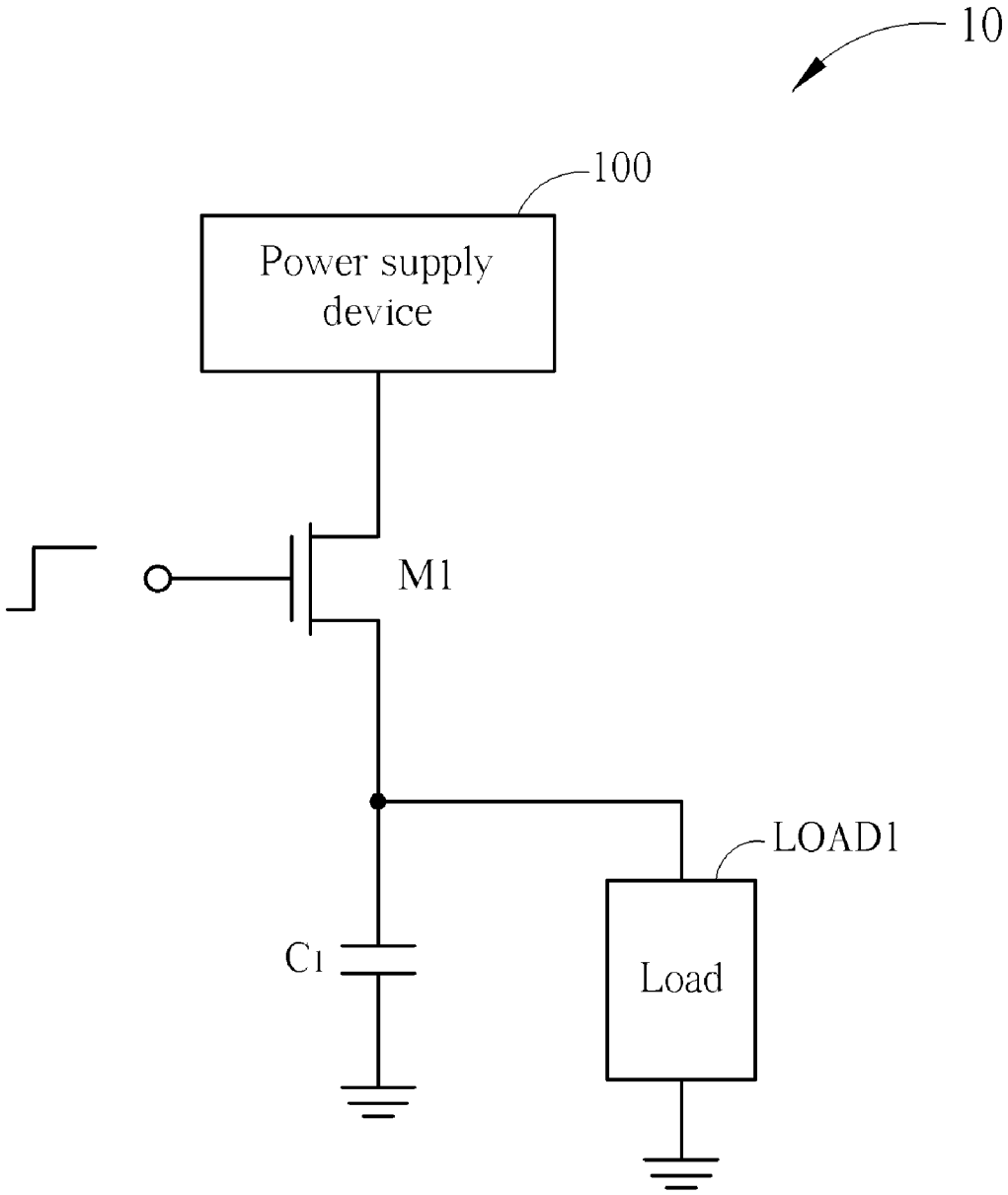
FIG. 1A is a schematic diagram of a conventional electronic device.
Figure 1B:
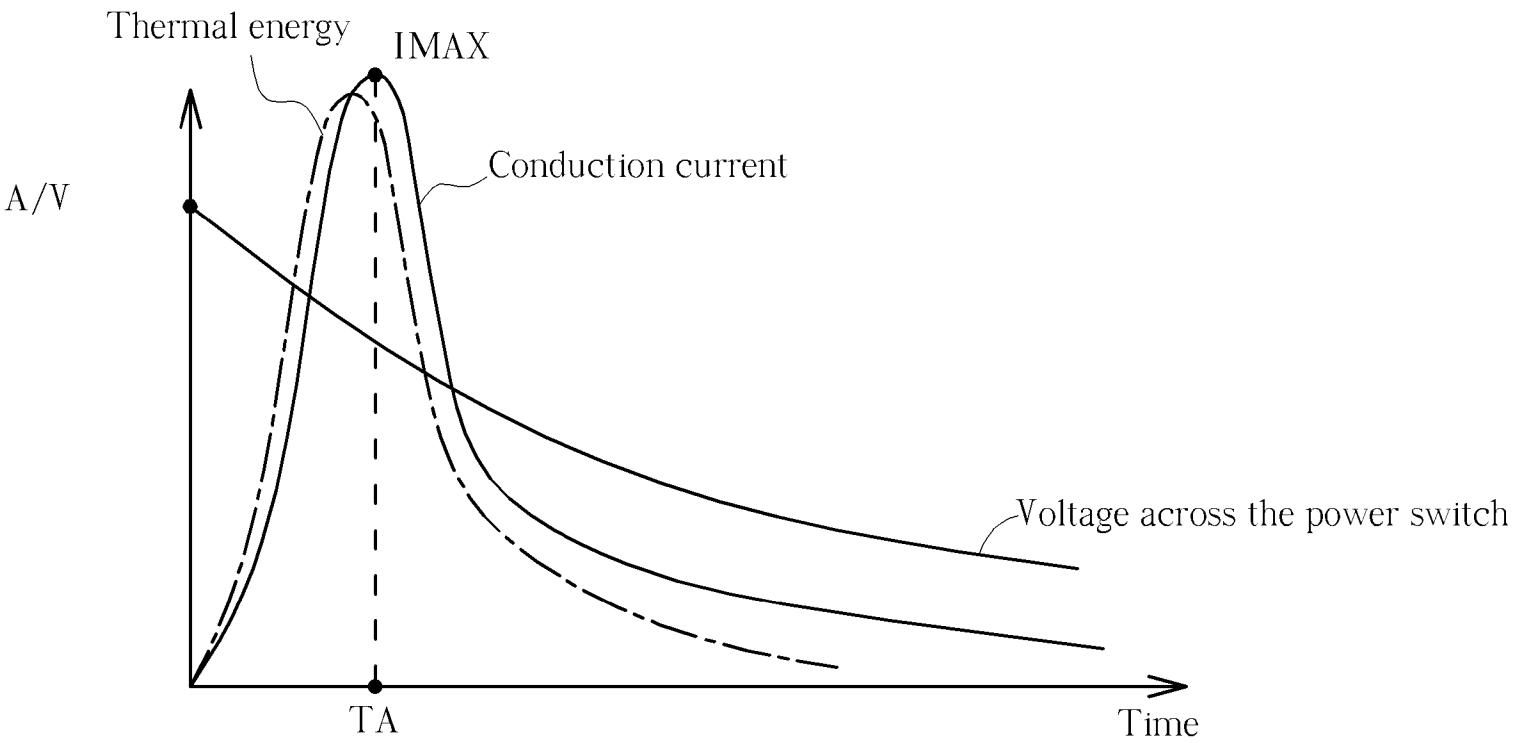
Figure 4:
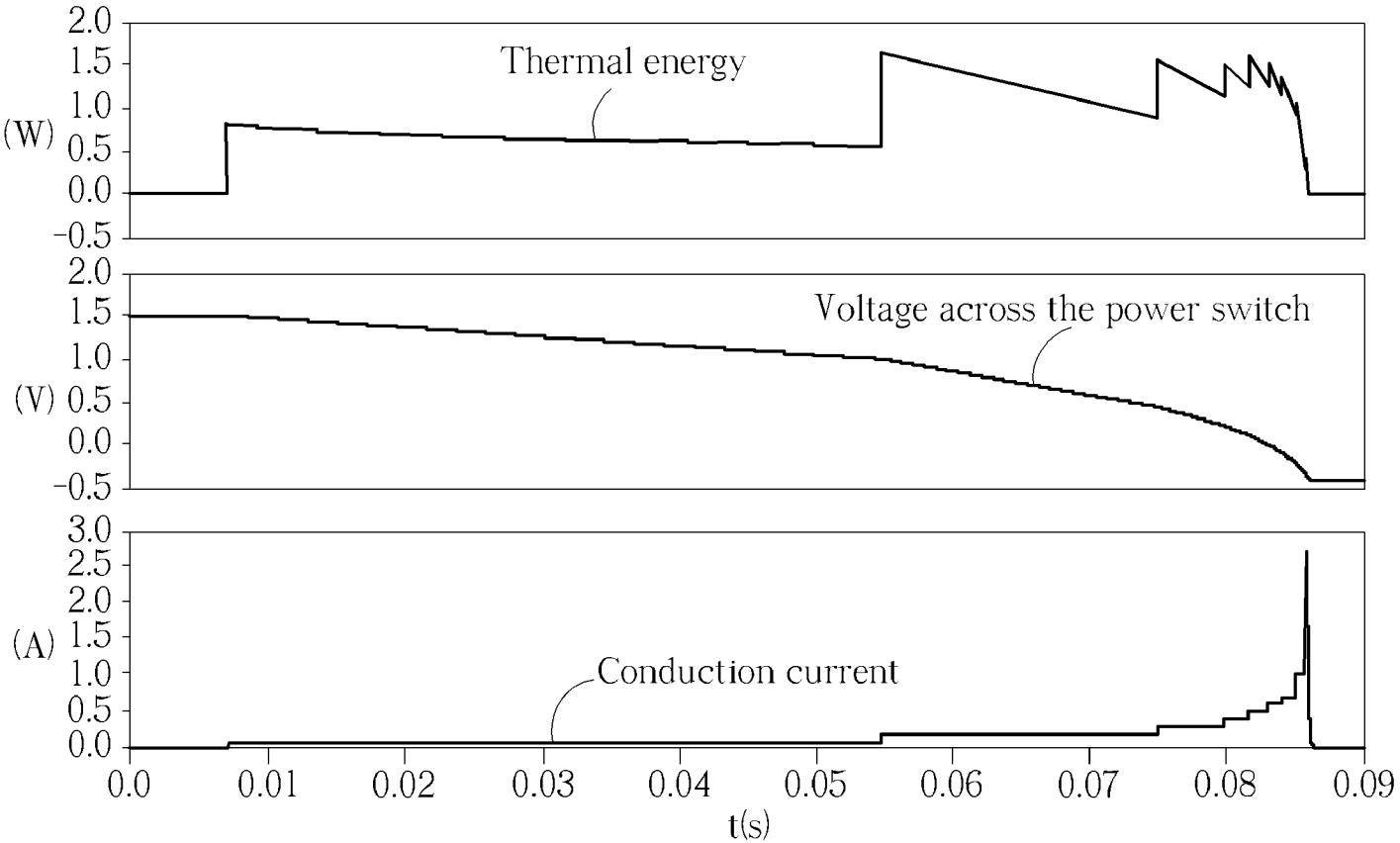

Please refer to FIG. 4, which is a time distribution diagram showing the voltage drop, the conduction current and the thermal energy of the power switch 202 when the electronic device is turned on according to an embodiment of the present invention. In comparison with the conduction current and the thermal energy shown in FIG. 1B, the present invention controls power consumption distribution of the power switch by controlling the conduction current of the power switch. Thus, a peak value of the thermal energy distribution is significantly reduced, and a shape of thermal energy distribution is smoother. As can be seen from the thermal energy distribution shown in FIG. 4, the possibility of overheating of the power switch 202 when power is turned on is significantly reduced.

Figure 2C:
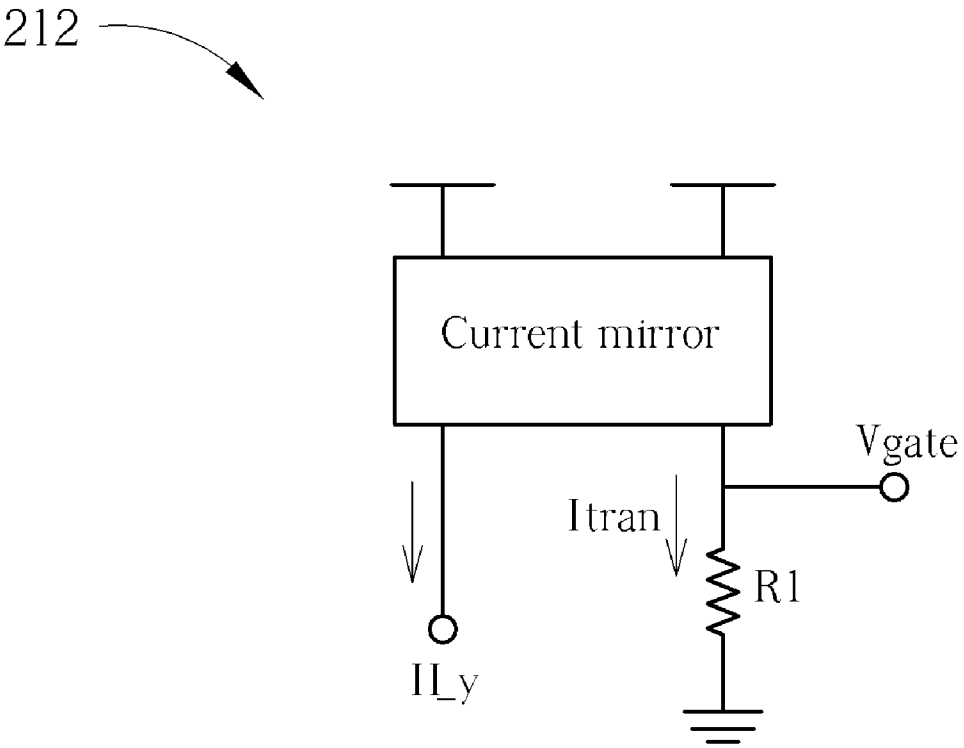
FIG. 2C is a schematic diagram of the switch control unit in FIG. 2A.

In a word, the embodiments shown in FIG. 2A-2C, and alterations shown in FIG. 3A-3C are operated according to the principles of the present invention: First, the adaptive control unit acts as a smart state machine, which detects voltage difference between the input terminal and the output terminal or conduction current of the power switch 202, to select the magnitude of the conduction current in the next stage, so as to gradually increase conduction current. Therefore, since the current flowing through the power switch 202 is gradually increased, the power switch would not have a great voltage difference and a great conduction current (or current surge) at the same time, and can gradually release thermal energy. Then, after the power switch is normally turned on, other circuits can start operating as well. Noticeably, in order to gradually increase the current, more increasing steps for conduction current are needed. Preferably, more than 3 steps are required. According to experimental results, with more increasing steps, the present invention can control conduction current more accurately, but the control circuit becomes more complicated and a larger chip area is needed. Therefore, proper increasing steps need to be selected according to requirements.

In addition, the power switch of the electronic device can be replaced by a bipolar junction transistor (BJT), which regulates conduction current between a collector and an emitter by controlling current or voltage of a base. According to the concept of the present invention, the BJT can act as a power switch capable of dissipating power as well, which is known by those skilled in the art, and not narrated hereafter.

To sum up, the present invention can control the current flowing through the power switch of the electronic device after power-on, such that the thermal energy released by the power switch can be controlled within a tolerable range. Therefore, the present invention can avoid activation of overheating protection mechanism of the power switch, to prevent abnormal operations or device immediately burnt out due to overheating, so as to enhance reliability and reduces production cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device capable of regulating a power switch to dissipate power, comprising:
- a power supply device, for supplying a power voltage;
- a power switch, for providing an output voltage; and
- a current regulating circuit comprising:
- an adaptive control unit, for outputting a regulating signal according to a voltage difference between the power voltage and the output voltage;
- Wherein the adaptive control unit comprises:
- a voltage divider, for providing a plurality of standard voltages;
- a multiplexer, coupled to the voltage divider, for selecting a standard voltage from the plurality of standard voltages according to a first selection signal, to output a feedback reference voltage;
- a comparator, for comparing the feedback reference voltage and the output voltage, to output a trigger signal;
- a counter, for increasing a count value according to a timing signal, and resetting the count value according to the trigger signal;
- a logic controller, coupled to the counter, for outputting the first selection signal and a second selection signal according to the count value; and
- a regulated current generator, for selecting a reference current from a plurality of reference currents according to the second selection signal, to output the regulating signal of the adaptive control unit; and
- a switch control unit, for outputting a switch control signal to a control terminal of the power switch according to the regulating signal, to control current flowing through the power switch.

2. The electronic device of claim 1 further comprising:
- an output capacitor, coupled to the power switch, for receiving the output voltage provided by the power switch to store electrical power; and
- a load, for providing a power load.

3. The electronic device of claim 1, wherein the switch control unit comprises:
- a current mirror, for outputting a conversion current according to the regulating signal of the adaptive control unit; and
- a resistor, for converting the conversion current into a voltage signal, to output the switch control signal.

4. The electronic device of claim 1 further comprising a sensing resistor, coupled between the power supply device and the power switch, and a voltage drop of the sensing resistor is corresponding to the current flowing through the power switch.

5. The electronic device of claim 4, wherein the adaptive control unit comprises:

a voltage divider, for providing a plurality of standard voltages;

a multiplexer, coupled to the voltage divider, for selecting a standard voltage from the plurality of standard voltages according to a first selection signal, to output a feedback reference voltage;

a comparator, for comparing the feedback reference voltage and the output voltage, to output a trigger signal;

a counter, for increasing a count value according to a timing signal, and resetting the count value according to the trigger signal;

a logic controller, coupled to the counter, for outputting the first selection signal and a second selection signal according to the count value; and a regulated current generator, for selecting a reference current from a plurality of reference currents according to the second selection signal, to output the regulating signal of the adaptive control unit.

6. The electronic device of claim 4, wherein the switch control unit is a comparator, for comparing voltages of the regulating signal and the sensing resistor, to output the switch control signal.

7. A current regulating circuit for regulating power dissipation of a power switch utilized for regulating a power voltage outputted by a power supply device to provide an output voltage, the current regulating circuit comprising:

an adaptive control unit, for outputting a regulating signal according to a voltage difference between the power voltage and the output voltage; wherein the adaptive control unit comprises:

a voltage divider, for providing a plurality of standard voltages;

a multiplexer, coupled to the voltage divider, for selecting a standard voltage from the plurality of standard voltages according to a first selection signal, to output a feedback reference voltage;

a comparator, for comparing the feedback reference voltage and the output voltage, to output a trigger signal;

a counter, for increasing a count value according to a timing signal, and resetting the count value according to the trigger signal;

a logic controller, coupled to the counter, for outputting the first selection signal and a second selection signal according to the count value; and a regulated current generator, for selecting a reference current from a plurality of reference currents according to the second selection signal, to output the regulating signal of the adaptive control unit; and a switch control unit, for outputting a switch control signal to a control terminal of the power switch according to the regulating signal, to control current flowing through the power switch.

8. The current regulating circuit of claim 7, wherein the switch control unit comprises:

a current mirror, for outputting a conversion current according to the regulating signal of the adaptive control unit; and a resistor, for converting the conversion current into a voltage signal, to output the switch control signal.

9. The current regulating circuit of claim 7 further comprising a sensing resistor, coupled between the power supply device and the power switch, and a voltage drop of the sensing resistor is corresponding to the current flowing through the power switch.

10. The current regulating circuit of claim 9, wherein the adaptive control unit comprises:

a voltage divider, for providing a plurality of standard voltages;

a multiplexer, coupled to the voltage divider, for selecting a standard voltage from the plurality of standard voltages according to a first selection signal, to output a feedback reference voltage;

a comparator, for comparing the feedback reference voltage and the output voltage, to output a trigger signal;

a counter, for increasing a count value according to a timing signal, and resetting the count value according to the trigger signal;

a logic controller, coupled to the counter, for outputting the first selection signal and a second selection signal according to the count value; and a regulated current generator, for selecting a reference current from a plurality of reference currents according to the second selection signal, to output the regulating signal of the adaptive control unit.

11. The current regulating circuit of claim 9, wherein the switch control unit is a comparator, for comparing voltages of the regulating signal and the sensing resistor, to output the switch control signal.

* * * * *